US007356287B2

(12) United States Patent
Guzman et al.

(10) Patent No.: US 7,356,287 B2
(45) Date of Patent: Apr. 8, 2008

(54) INK DEVELOPER FOIL

(75) Inventors: Marco A. Guzman, San Diego, CA (US); Ziv Gilan, San Diego, CA (US); Christopher S. Tanner, La Mesa, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 169 days.

(21) Appl. No.: 11/032,521

(22) Filed: Jan. 10, 2005

(65) Prior Publication Data

US 2006/0153597 A1 Jul. 13, 2006

(51) Int. Cl.
*G03G 15/10* (2006.01)

(52) U.S. Cl. ..... 399/237; 399/241; 399/249

(58) Field of Classification Search ..... 399/237–251
See application file for complete search history.

(56) References Cited

U.S. PATENT DOCUMENTS 4,423,134 A 12/1983 Miyakawa
4,883,018 A * 11/1989 Sagiv ..... 399/247
5,481,342 A 1/1996 Arcaro et al.
5,506,372 A * 4/1996 Guth et al. ..... 399/254
5,923,412 A 7/1999 Ertel
5,943,536 A * 8/1999 Okada et al. ..... 399/239
6,125,254 A 9/2000 Chang et al.
6,337,963 B1 * 1/2002 Kusayanagi ..... 399/237
2004/0175206 A1 * 9/2004 Landa et al. ..... 399/237

FOREIGN PATENT DOCUMENTS

EP 0989471 2/2002
JP 61262767 11/1986

* cited by examiner

*Primary Examiner*—Andrew H. Hirshfeld
*Assistant Examiner*—Timothy J Dole

(57) ABSTRACT

In one implementation, an apparatus includes a foil that is adjacent to a portion of an ink developer electrode. The foil at least partially limits an accumulation of splashed ink along one or more portions of the ink developer electrode.

43 Claims, 4 Drawing Sheets

INK DEVELOPER FOIL

BACKGROUND

In printing devices that utilize ink, the uncontrolled flow of ink can result in splashing. As the ink splashes, it can adhere to some parts of the printing device. Over time, the carrier liquid is evaporated and the accumulated layers of concentrated ink (or sludge) can block or limit the flow of ink, which in turn can result in malfunctions and breakdowns. Cleaning the parts that contain the accumulated ink can be time-consuming and costly. Also, cleaning the accumulated ink can be difficult without disassembling the device, which sometimes makes this option infeasible in the field.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION

Exemplary implementations for provision and/or utilization of an ink developer foil are described. The implementations provide efficient and/or low-cost solutions for limiting or eliminating ink splashes that may accumulate on some portions of a printing device over time. In one implementation, a fluid foil partially surrounds a main electrode of an ink developer unit. Moreover, the fluid foil may be electrically charged such that the splashed ink does not readily adhere to the foil.

Exemplary Ink Developer Device

Figure 1:
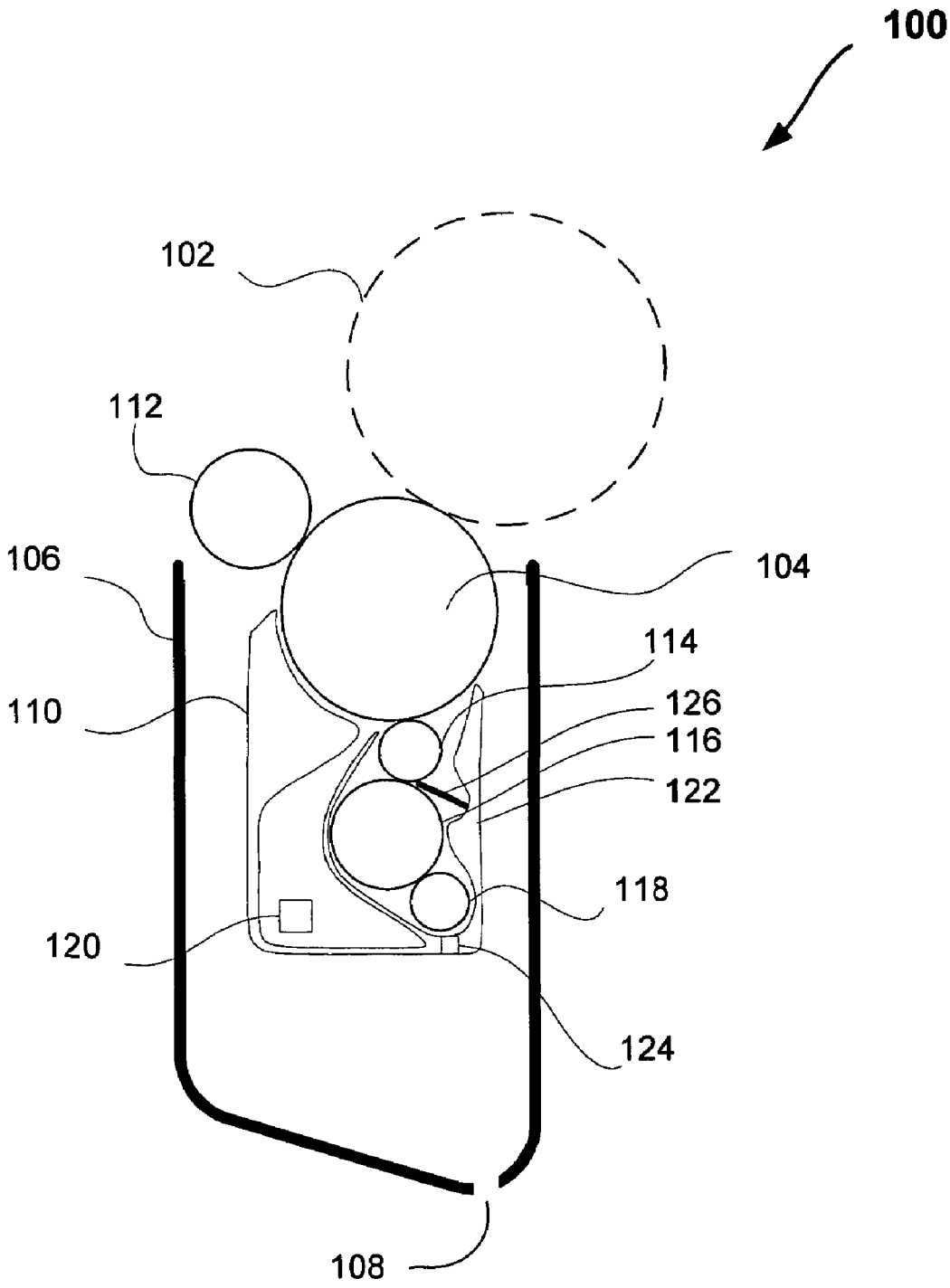
FIG. 1 illustrates an exemplary side view of an ink developer device, in accordance with an implementation.

FIG. 1 illustrates an exemplary side view of an ink developer device 100, in accordance with an implementation. The ink developer device 100 may be a binary ink developer (BID) unit. Furthermore, the device 100 may be utilized in liquid electro photography (LEP) printers.

The device 100 is coupled to a photo-conductive drum 102 that is charged and then selectively exposed to a laser (not shown) to form a charge pattern corresponding to an image. The device 100 includes an ink developer roller (104) that is contacted with the drum 102 to selectively transfer a liquid ink pattern to the charged pattern. Next, the liquid ink pattern is transferred from the photoconductive drum 102 to a media such as paper or to an intermediate transfer member (not shown) to form an image on the media.

The device 100 also includes an ink tray 106 (e.g., to hold excess ink and direct it to an ink outlet 108), a main electrode (back wall) 110 (e.g., to support the various parts of the device 100 such as the illustrated rollers), a squeegee roller 112 (e.g., to remove excess ink from the developer roller 104), a cleaning roller 114 (e.g., to clean the developer roller 104), a sponge roller 116 (e.g., to absorb excess ink from a wiper blade 126 and/or the cleaning roller 114), a squeegee roller 118 (e.g., to squeeze the sponge roller 116 to remove excess ink), an ink inlet 120 (e.g., to supply fresh or recycled ink (such as from the ink outlet 108) to the device 100), a main electrode (front wall) 122 (e.g., to support the various parts of the device 100 such as the illustrated rollers), and an ink drain passage 124 (e.g., to allow drainage of excess ink from the main electrode (110, 122)). The wiper blade 126 may come in contact with the sponge roller 116 and/or the cleaning roller 114 to clean one or both of them.

Exemplary Ink Flow

Figure 2:
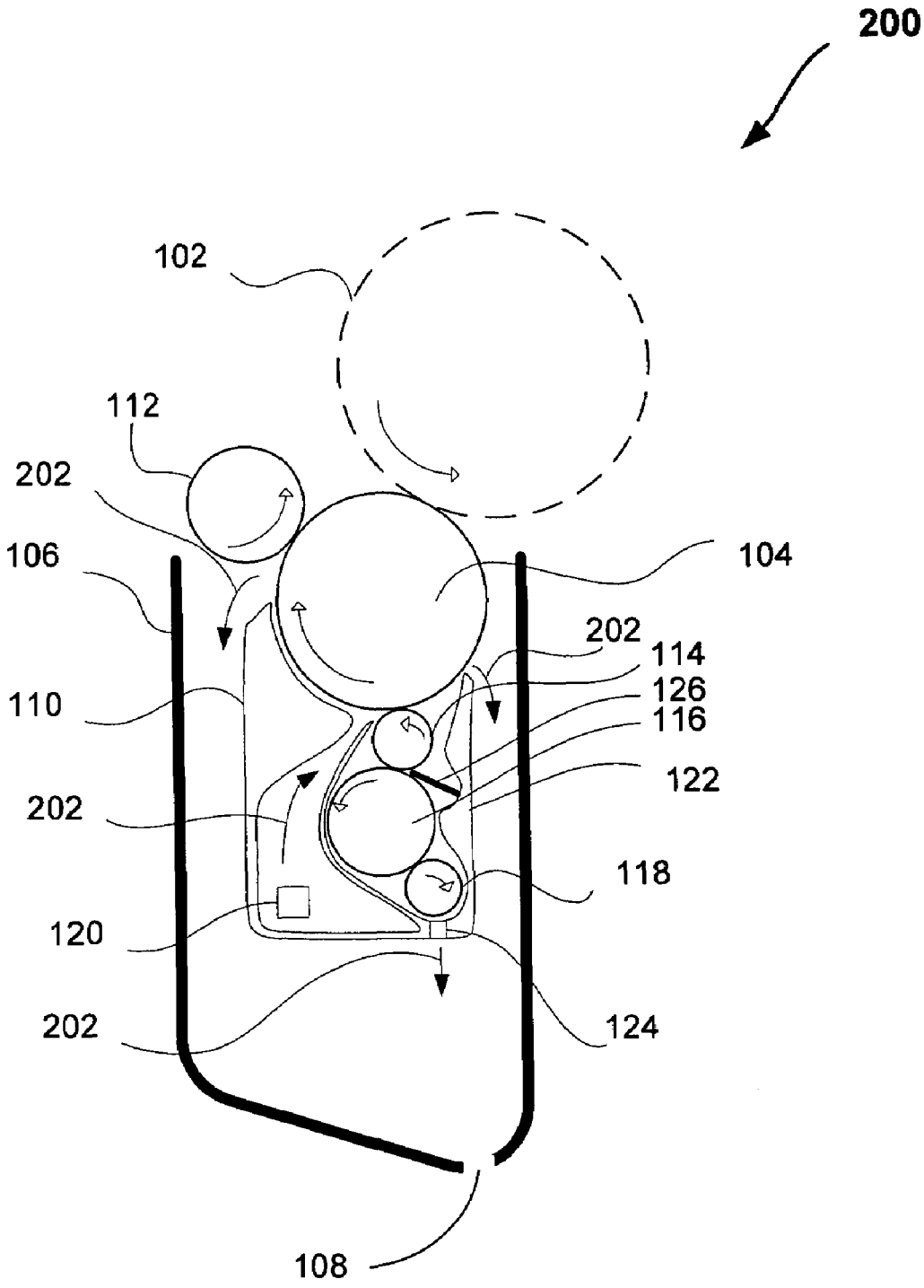
FIG. 2 illustrates an exemplary flow of ink in an ink developer device, according to an implementation.

FIG. 2 illustrates an exemplary flow of ink in an ink developer device 200, according to an implementation. In one implementation, the device 200 may be the same or similar to the device 100 discussed with reference to FIG. 1. For example, the device 200 includes the ink developer roller 104, ink tray 106, ink outlet 108, main electrode (back wall) 110, squeegee roller 112, cleaning roller 114, sponge roller 116, squeegee roller 118, ink inlet 120 , main electrode (front wall) 122, ink drain passage 124, and wiper 126. Also, the arrows inside each roller indicate the exemplary rotational direction of the respective roller. For example, items 102, 112, 114, and 116 may rotate in a counter-clockwise direction, whereas items 104 and 118 may rotate in a clockwise direction. It is envisioned that the rollers may rotate in other suitable directions.

As illustrated in FIG. 2 by arrows 202, the device 100 receives fresh (or recycled) ink from the ink supply (120). This ink travels upward in the configuration of FIG. 2 and attaches to the charged developer roller 104 due to a potential bias between the main electrode (110, 122) and the developer roller 104. The squeegee roller 112 regulates the ink film thickness on the developer roller 104. Ink is selectively transferred from the developer roller 104 to the charged portions of the drum surface (102). The cleaning roller 114 removes leftover ink from the developer roller 104. The wiper blade 126 cleans the cleaning roller 114 and/or the sponge roller 116. The sponge roller 116 cleans the cleaner roller 114. In one implementation, to provide a relatively cleaner recycled ink, the device 100 utilizes the cleaning parts (such as 112, 114, 116, and 118) which are envisioned to minimize sludge buildup. As illustrated in FIG. 2, excess ink may be drained from the ink drain passage 124, top side of the main electrode (front wall) 122, and/or top side of the main electrode (back wall) 110 into the ink tray 106, where it can be picked up by the ink outlet 108.

In some implementations, the devices 100 and 200 are wholly replaceable. Various life-limiting aspects of the device 100 (or 200) may include: (1) limited life of the developer roller 104; (2) sludge buildup inside the device 100 (or 200); and (3) wear of various internal parts. Moreover, sludge may accumulate in several areas of the device 100 (or 200) such as one or more of the following: (a) between the main electrode (whether front wall 122 or back wall 110) and the developer roller 104; (b) on the outside wall of the main electrode (i.e., the side facing towards the ink tray 106); and (c) on the sides or bottom of the ink tray 106. Also, the device 100 (or 200) may be a consumable, and, e.g., made from custom and/or off the shelf parts. In one implementation, upon failure of any component of this consumable, the entire device is replaced.

Exemplary Fluid Foil

Figure 3:
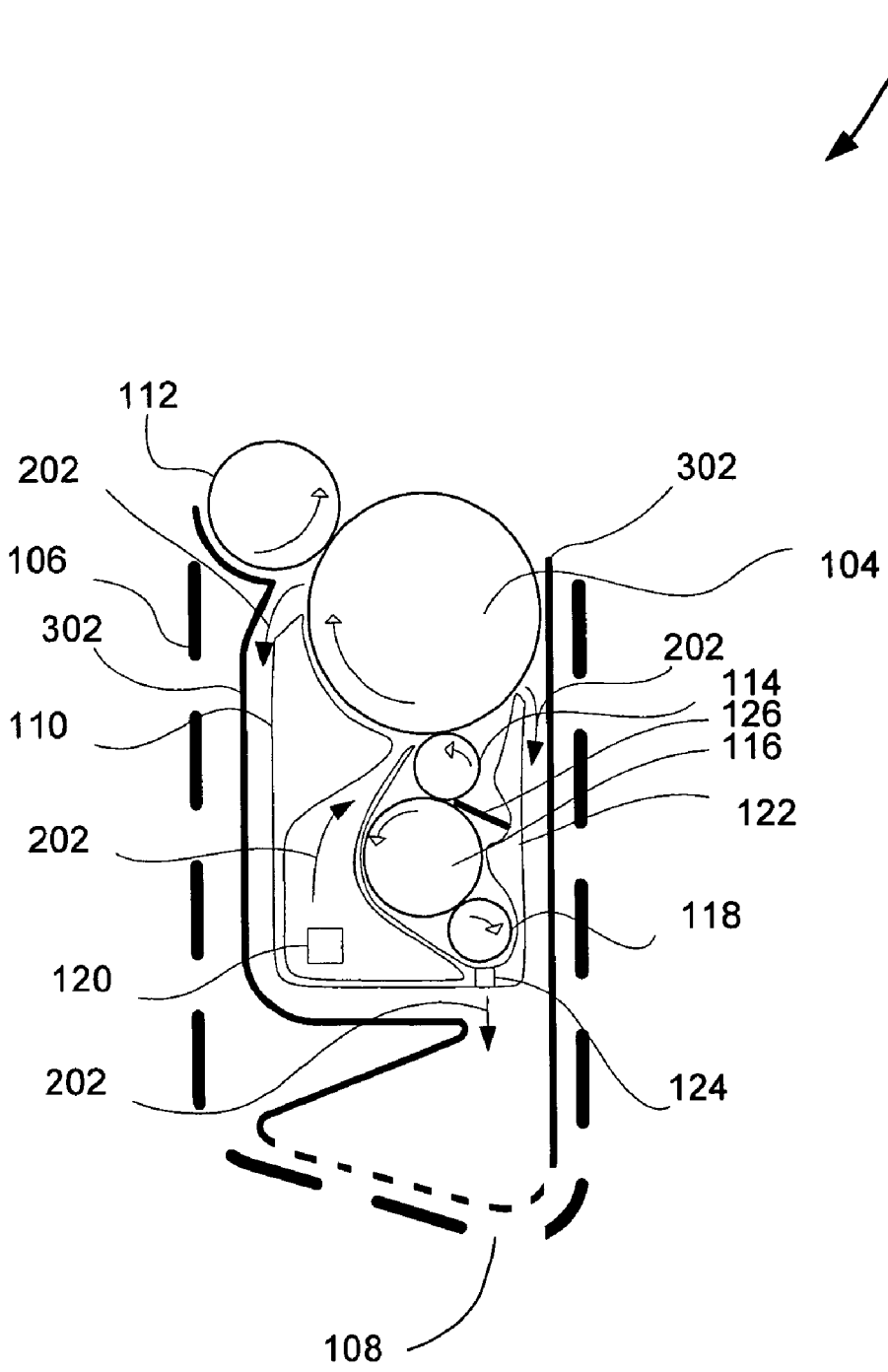
FIG. 3 illustrates an exemplary ink developer device with a fluid foil, in accordance with an implementation.

FIG. 3 illustrates an exemplary ink developer device 300 with a fluid foil. In one implementation, the device 300 may be the same or similar to the devices 100 and 200 discussed with reference to FIGS. 1 and 2. For example, the device 300 includes the ink developer roller 104, ink tray 106, ink outlet 108, main electrode (back wall) 110, squeegee roller 112, cleaning roller 114, sponge roller 116, squeegee roller 118, ink inlet 120, main electrode (front wall) 122, ink drain passage 124, and wiper 126. Also, as discussed with reference to FIG. 2, the arrows inside each roller indicate the exemplary rotational direction of the respective roller.

The ink developer device 300 further includes a foil 302 which may be adjacent to and/or at least partially surround the main electrode (110, 122). As illustrated in FIG. 3, the fluid foil 302 may optionally only surround the main electrode on the two sides (e.g., two foils, one on each side of the main electrode), and, e.g., be absent on the bottom side (illustrated by dashes). In one implementation (such as that illustrated in FIG. 3), the fluid foil 302 may closely follow the curvature of the squeegee roller 112 and the lower left side of the main electrode (adjacent the ink inlet 120 up to the drain passage 124). It is also envisioned that the fluid foil may have other shapes. For example, the fluid foil 302 may also closely follow the curvature of the drum 102 (not shown). More generally, the fluid foil may be present in any location that may benefit from a reduction of ink splashes or sludge buildup.

In one implementation, the fluid foil 302 may be electrically charged such that the splashed ink does not readily adhere to the foil. For example, the fluid foil 302 may be charged to the same potential level as the main electrode (110, 122) to discourage the splashed ink from attaching to either the main electrode or the fluid foil. For example, the main electrode and the foil may be electrically coupled to each other, or alternatively to a same voltage source. In an implementation, the electrode and the fluid foil may be charged to about −1,500 V, whereas the squeegee roller 112 may be charged to about −750 V and the developer roller 104 to about −450 V.

Additionally, the gap between the fluid foil 302 and the main electrode (110, 122) (or other parts of the ink developer device 300) may be at about 2 mm. The gap between the rollers (e.g., 112 and 104) and the foil 302 may be at about 1 mm or less. Furthermore, the fluid foil 302 may be made of any electrically conductive material that may be chemically non-reactive with the fluids utilized in the ink developer (e.g., ink and/or carrier liquid), such as steel, stainless steel, plastic with coating (e.g., Ultem® brand coating which may include polyetherimide and/or Teflon® brand coating which may include polytetrafluoroethylene), combinations thereof, and the like. Accordingly, the back and front wall foils illustrated in FIG. 3 may serve as guides to channel the ink flow. This is envisioned to minimize flow patterns that are undesirable or detrimental to the ink developer performance and life. Also, in one implementation, the coating on the plastic (e.g., Teflon® brand coating or Ultem® brand coating) is applied to one side of the foil 302 (e.g., the side where ink may be present such as the side facing the electrode (110, 122)).

In various implementations, the utilization of the fluid foil 302 is envisioned to provide a tray-less ink developer unit (i.e., by eliminating the cost associated with providing the tray 106), eliminate or limit stagnation points where ink accumulates (e.g., along the top sides of the main electrode (110, 122) such as discussed with reference to FIG. 2), and/or eliminate or limit leakage points when the ink developer is put in a horizontal position in the printing device (versus the illustrated vertical position).

Exemplary Stagnation Point Removal

Figure 4:
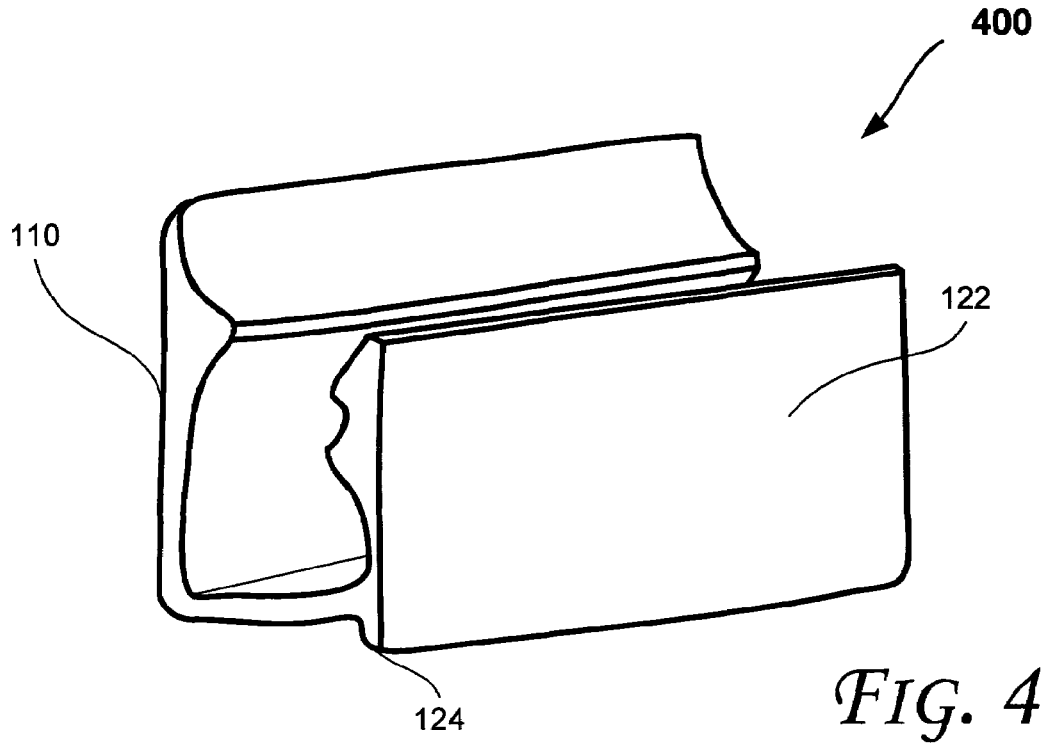
FIG. 4 illustrates an exemplary perspective view of a main electrode, according to an implementation.

FIG. 4 illustrates an exemplary perspective view of a main electrode 400, according to an implementation. As illustrated in FIG. 4, the main electrode 400 includes the main electrode (front wall) 122, the main electrode (back wall) 110, and the drain passage 124. To limit or eliminate the stagnation point created on top of the wiper 126 (FIGS. 1-3), the main electrode (front wall) may be modified as illustrated by a main electrode 500 of FIG. 5.

Figure 5:
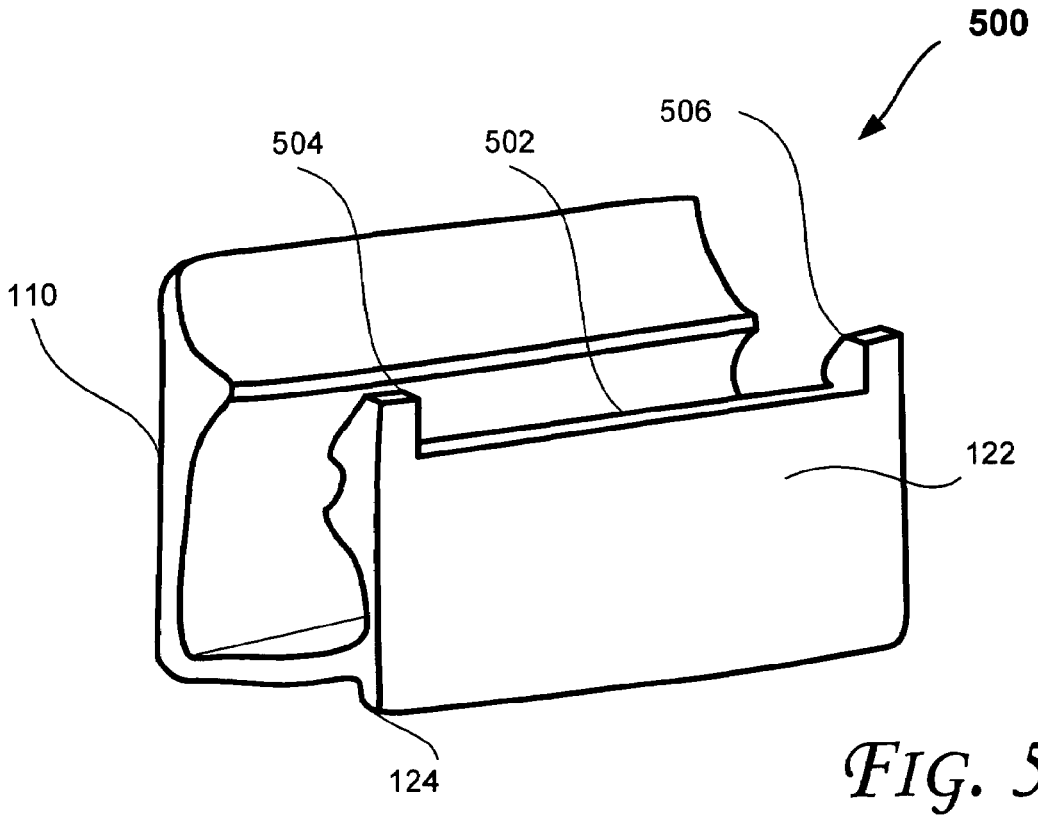
FIG. 5 illustrates an exemplary perspective view of a modified main electrode, according to an implementation.

As illustrated in FIG. 5, the modification opens up a channel 502 for the ink to flow more freely between two prototyping support structures (504, 506). In one implementation, this change in conjunction with the addition of the foils (e.g., 302 of FIG. 3) can maintain the flow of ink relatively close to the main electrode walls (110, 122), thereby eliminating or limiting splashes and/or ink accumulation in select portions of the electrode. The two prototyping support structures (504, 506) are envisioned to facilitate prototyping or simplify tooling changes during the manufacturing or modification of the main electrode (500). Also, the two prototyping support structures (504, 506) can be removed in an implementation. It is additionally envisioned that similar modifications may be made to the back wall of the main electrode (e.g., along the top side of the back wall of the main electrode (110)).

Reference in the specification to "one implementation" or "an implementation" means that a particular feature, structure, or characteristic described in connection with the implementation is included in at least an implementation. The appearances of the phrase "in one implementation" in various places in the specification are not necessarily all referring to the same implementation.

Thus, although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

What is claimed is:

1. An apparatus comprising:

an ink developer electrode including a first portion supporting at least one roller and a second portion supporting at least one other roller; and a fluid foil adjacent to and at least partially surrounding the first portion and the second portion of the ink developer electrode, wherein the fluid foil is electrically charged to a same potential as the ink developer electrode.

2. The apparatus of claim 1, wherein the fluid fail is electrically conductive.

3. The apparatus of claim 1, wherein the fluid foil at least partially limits an accumulation of splashed ink along one or more portions of the ink developer electrode.

4. The apparatus of claim 1, wherein the potential is in a range of −1,500 V.

5. The apparatus of claim 1, wherein the fluid foil is constructed from a material selected from a group comprising steel, stainless steel, plastic with coating, and combinations thereof.

6. The apparatus of claim 5, wherein the coating comprises one or more of polyetherimide or polytetrafluoroethylene.

7. The apparatus of claim 1, wherein the fluid foil is chemically non-reactive with one or more fluids utilized by the ink developer electrode.

8. The apparatus of claim 1, wherein the fluid foil is electrically charged to limit splashed ink from adhering to the fluid foil.

9. The apparatus of claim 1 further comprising a plurality of fluid foils.

10. The apparatus of claim 1, further comprising a plurality of fluid foils at least disposed adjacent to a back wall and a front wall of the ink developer electrode.

11. The apparatus of claim 1, wherein the ink developer electrode is modified to at least limit one or more stagnation points.

12. The apparatus of claim 1, wherein the ink developer electrode is utilized in a printing device.

13. The apparatus of claim 1, wherein the ink developer electrode is utilized in a liquid electro photography (LEP) printing device.

14. The apparatus of claim 1, wherein the fluid foil follows a profile of the ink developer electrode.

15. The apparatus of claim 1, wherein the fluid foil serves as a guide to channel ink flow.

16. A method comprising:

supporting at least one roller with a first portion of an ink developer electrode, and supporting at least one other roller with a second portion of the ink developer electrode; and providing a fluid foil adjacent to and partially surrounding the first portion and the second portion of the ink developer electrode, wherein the fluid foil is electrically charged to a same potential as the ink developer electrode.

17. The method of claim 16, wherein the fluid foil is electrically conductive.

18. The method of claim 16, wherein the fluid foil at least partially limits an accumulation of splashed ink along one or more portions of the ink developer electrode.

19. The method of claim 16, wherein the potential is in a range of −1,500 V.

20. The method of claim 16, wherein the fluid foil is constructed from a material selected from a group comprising steel, stainless steel, plastic with coating, and combinations thereof.

21. The method of claim 20, wherein the coating comprises one or more of polyetherimide or polytetrafluoroethylene.

22. The method of claim 16, wherein the fluid foil is chemically non-reactive with one or more fluids utilized by the ink developer electrode.

23. The method of claim 16, further comprising electrically charging the fluid foil to limit splashed ink from adhering to the fluid foil.

24. The method of claim 16, further comprising providing a plurality of fluid foils.

25. The method of claim 16, further comprising providing a plurality of fluid foils at least disposed adjacent to a back wall and a front wall of the ink developer electrode.

26. The method of claim 16, further comprising modifying the ink developer electrode to at least limit one or more stagnation points.

27. The method of claim 16, further comprising utilizing the ink developer electrode in a printing device.

28. The method of claim 16, further comprising utilizing the ink developer electrode in a liquid electro photography (LEP) printing device.

29. The method of claim 16, wherein providing the fluid foil adjacent to and partially surrounding the first portion and the second portion of the ink developer electrode includes following a profile of the ink developer electrode with the fluid foil.

30. An apparatus comprising:

means for supporting at least one roller with a first portion of an ink developer electrode and supporting at least one other roller with a second portion of the ink developer electrode;

means adjacent to the ink developer electrode for partially surrounding the first portion and the second portion of the ink developer electrode; and means for electrically charging the ink developer electrode and the means adjacent to the ink developer electrode to a same potential.

31. The apparatus of claim 30, further comprising means for modifying the ink developer electrode to at least limit one or more stagnation points.

32. A replaceable printer component comprising:

an ink developer electrode including a first portion configured to support a developer roller and a second portion configured to support at least one of a cleaning roller, a sponge roller, and a squeegee roller; and a fluid foil adjacent to and at least partially surrounding the first portion and the second portion of the ink developer electrode, wherein, in use, the fluid foil is electrically charged to a same potential as the ink developer electrode to prevent accumulation of ink on the ink developer electrode and the fluid foil.

33. The component of claim 32, wherein the fluid foil is electrically conductive.

34. The component of claim 32, wherein the fluid foil at least partially limits an accumulation of splashed ink along one or more portions of the ink developer electrode.

35. The component of claim 32, wherein the potential is in a range of −1,500 V.

36. The component of claim 32, wherein the fluid foil is constructed from a material selected from a group comprising steel, stainless steel, plastic with coating, and combinations thereof.

37. The component of claim 36, wherein the coating comprises one or more of polyetherimide or polytetrafluoroethylene.

38. The component of claim 32, wherein the fluid foil is chemically non-reactive with one or more fluids utilized by the ink developer electrode.

39. The component of claim 32, further comprising a plurality of fluid foils.

40. The component of claim 32, further comprising a plurality of fluid foils at least disposed adjacent to a back wall and a front wall of the ink developer electrode.

41. The component of claim 32, wherein the ink developer electrode is modified to at least limit one or more stagnation points.

42. The component of claim 32, wherein the ink developer electrode is utilized in a liquid electro photography (LEP) printing device.

43. The component of claim 32, wherein the fluid foil follows a profile of the ink developer electrode and serves as a guide to channel ink flow.

* * * * *

UNITED STATES PATENT AND TRADEMARK OFFICE

CERTIFICATE OF CORRECTION

PATENT NO. : 7,356,287 B2
APPLICATION NO. : 11/032521
DATED : April 8, 2008
INVENTOR(S) : Marco A. Guzman et al.

It is certified that error appears in the above-identified patent and that said Letters Patent is hereby corrected as shown below:

In column 2, line 4, delete “squeegee” and insert -- squeezer --, therefor.

In column 2, line 22, delete “squeegee” and insert -- squeezer --, therefor.

In column 3, line 5, delete “squeegee” and insert -- squeezer --, therefor.

In column 3, line 35, before “electrode” insert -- main --.

In column 4, line 51, in Claim 2, delete “fail” and insert -- foil --, therefor.

In column 5, line 4, in Claim 9, after “claim 1” insert -- , --.

In column 6, line 23, in Claim 32, delete “squeegee” and insert -- squeezer --, therefor.

Signed and Sealed this

Fifth Day of August, 2008

JON W. DUDAS
*Director of the United States Patent and Trademark Office*